US005131826A

United States Patent [19]

Boussicault

[11] Patent Number: 5,131,826

[45] Date of Patent: Jul. 21, 1992

[54] ROLLING PISTON ROTARY MACHINE WITH VANE CONTROL

[75] Inventor: Christian Boussicault, Leognan, France

[73] Assignee: Elf Sanofi, Paris, France

[21] Appl. No.: 618,918

[22] Filed: Nov. 28, 1990

[30] Foreign Application Priority Data

Nov. 28, 1989 [FR] France ..... 89 15654

[51] Int. Cl.[5] ..... F01C 1/356

[52] U.S. Cl. ..... 418/23; 418/63

[58] Field of Search ..... 418/23, 63, 158

[56] References Cited

U.S. PATENT DOCUMENTS

| | | | |
|---|---|---|---|
| 2,671,605 | 3/1954 | Grumblatt | 418/158 |
| 3,674,385 | 7/1972 | Rohde . | |
| 4,397,618 | 8/1983 | Stenzel | 418/23 |

FOREIGN PATENT DOCUMENTS

| | | | |
|---|---|---|---|
| 1008520 | 2/1952 | France | 418/158 |
| 2470267 | 5/1981 | France . | |
| 214899 | 10/1984 | German Democratic Rep. | 418/23 |
| 55-66693 | 5/1980 | Japan | 418/23 |
| 1247786 | 10/1989 | Japan | 418/23 |
| 484707 | 5/1938 | United Kingdom . | |
| 2106185 | 4/1983 | United Kingdom | 418/23 |

*Primary Examiner*—John J. Vrablik

*Attorney, Agent, or Firm*—Bacon & Thomas

[57] ABSTRACT

The rotary machine comprises a cylindrical chamber having a rolling piston rotating therein, the piston rolling against the inside surface of the chamber wall. In normal operation, springs keep a vane pressed against the periphery of the rolling piston. A control device for controlling the piston of the vane comprises a control rod lying in the same plane as the vane. The rod includes a retaining abutment formed at the bottom of the control rod and received in a housing formed inside the vane and including a top wall through which the control rod passes, the top wall co-operating with the abutment and the housing having a vertical extent which is not less than the maximum distance between the peripheral surface of the piston and the casing of the rotary machine, thereby enabling the vane to move freely relative to the abutment when the abutment is in its low position. Means for selectively controlling the rod to enable the vane to be moved to a disengaged position in which it is no longer in permanent contact with the peripheral surface of the rolling piston, thereby preventing the rotary machine from operating at full load.

7 Claims, 1 Drawing Sheet

FIG. 1
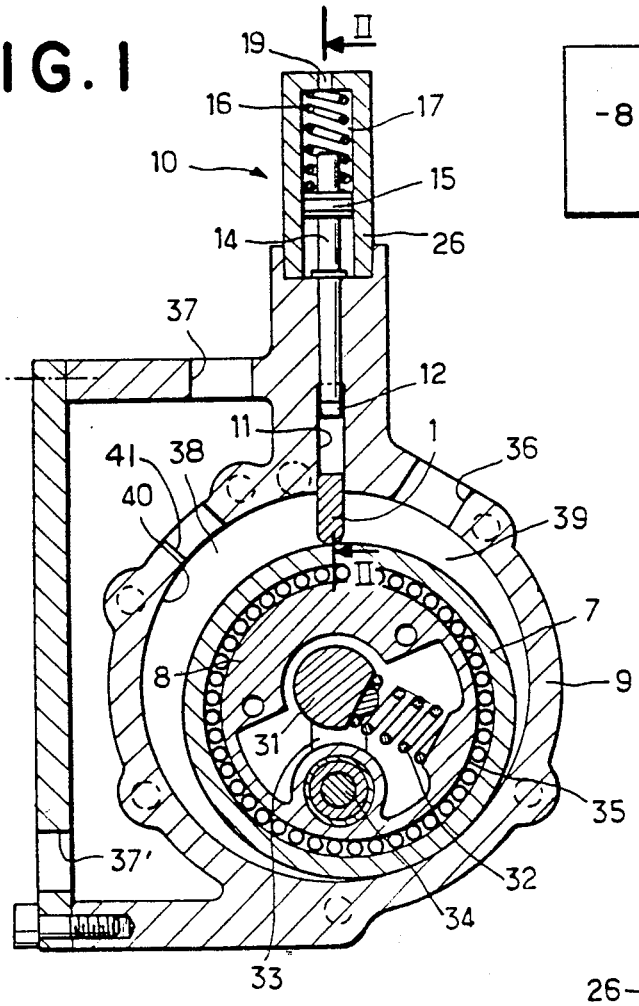
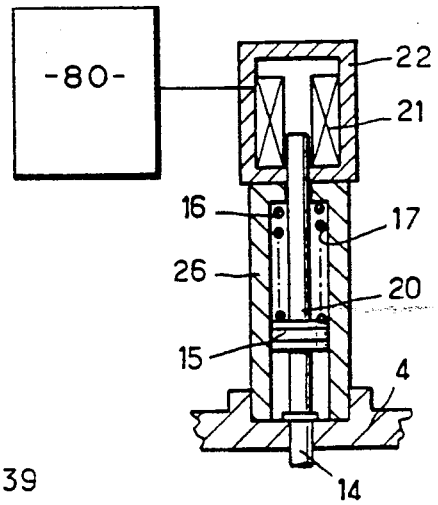
FIG. 3
FIG. 2
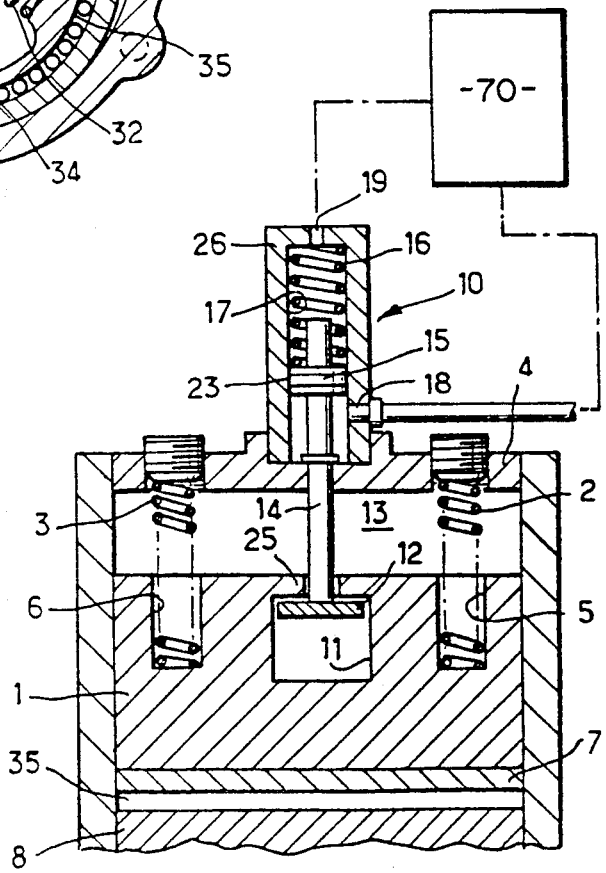

ROLLING PISTON ROTARY MACHINE WITH VANE CONTROL

FIELD OF THE INVENTION

The present invention relates to a rolling piston rotary machine comprising a casing, a cylindrical chamber formed inside the casing, a drive shaft coaxial with said chamber and provided with an eccentric, a rolling piston which rolls against the inside surface of the wall of the cylindrical chamber when the shaft rotates, a vane slidably mounted relative to the casing of the machine and dividing the empty space around the piston into a low pressure compartment into which a suction port for a fluid opens out, and a high pressure compartment into which a fluid delivery port opens out, at least one spring interposed between the casing and the vane to press the vane in normal operation against the peripheral surface of the rolling piston, and a control device for controlling the position of the vane, the control device comprising a control rod movable in translation under the action of selective control means and capable of moving between a first position in which the vane is kept in contact with the peripheral surface of the rolling piston with the motion of the vane not being limited by the control rod, and a second position in which the vane is held by the control rod in a disengaged position where it is not in permanent contact with the peripheral surface of the rolling piston, thereby preventing the rotary machine from operating at full load.

BACKGROUND OF THE INVENTION

Various types of rotary machine such as compressors, vacuum pumps, and hydraulic motors or pumps are provided with a rolling piston which rolls against the inside surface of the wall of a cylindrical chamber and which is coupled to a drive shaft via an eccentric portion or crank, which drive shaft is coaxial with said chamber, it being possible in a particular embodiment for the rolling piston to be mounted free to rotate around a drive ring which is itself connected to the crank.

In conventional manner, a separator blade or vane which is slidably mounted in the machine casing divides the empty space around the piston into two variable volume compartments, comprising a low pressure compartment into which a fluid suction port opens out, and a high pressure compartment into which a fluid delivery port opens out.

In normal operation, the separator vane is pressed against the periphery of the rolling piston by a spring interposed between the casing and the vane.

However, it is often desirable to be able to unload or limit the load on the rotary machine.

Proposals have already been made for doing this by means of a clutch for decoupling the machine from its drive member, or by means for clamping the suction port.

In the first case, providing a clutch tends to increase the weight of the machine and also its cost.

In the second case, the need to close the suction port causes considerable power to be absorbed to no purpose and constitutes a loss for which there is no return.

Proposals have also been made in Document FR-A-2 470 267 to remedy these drawbacks by using mechanical stop means for locking the separator vane in a position in which its free edge does not bear against the periphery of the rolling piston, at least during a portion of the motion of the piston. This document proposes providing the stop device in the form of a rod capable of moving in translation perpendicularly to the guide for the separator vane and having formed in the separator vane so as to hold the separator vane off the rolling piston while the rod is in its working position.

However, in practice, such an embodiment is unsatisfactory. In some applications the rolling piston rotates at very high speeds, of the order of several thousand revolutions per minute (rpm). It is therefore particularly difficult to cause a catch or finger that moves particularly to the displacement direction of the vane to penetrate into a notch in the vane oscillating as a function of the position of the rolling piston. Each time the catch enters the receiving notch formed in the vane, the catch suffers from wear as do the walls of the notch, and as a result the lifetime of the device is very limited. Further, on each occasion the catch enters or leaves the notch, the risk of jamming is not negligible. In addition, insofar as the vane can be retracted into a single position only, the prior device is unsuitable for regulating or progressively off-loading the power of the compressor.

The present invention seeks to remedy the abovementioned drawbacks, and to enable rolling piston rotary machines to be off-loaded or to have their power regulated in a manner which is simple, convenient, and efficient, using a device which is lightweight, robust, and cheap, and absorbing minimum power when off-loaded.

More precisely, an object of the invention is to enable the position of a vane in a rotary machine to be adjusted accurately and reliably while ensuring both a high degree of operating safety and great flexibility in operation.

SUMMARY OF THE INVENTION

These objects are achieved, by means of a rolling piston rotary machine of the type defined at the beginning of the description, in which the control rod is disposed in the same plane as the vane and includes a retaining abutment formed at the bottom end of the control rod and engaged in a housing formed in the vane, which housing includes a top wall through which the control rod passes, enabling the top wall to cooperate with said abutment, the vertical extent of the housing being not less than the maximum distance between the peripheral surface of the piston and the casing of the rotary machine, thereby allowing the vane to move freely relative to the abutment when the abutment is in its lowered position.

The stroke of the control rod is large enough to make it possible, if necessary, for the vane to be completely retracted when the abutment is in its raised or working position.

In a first embodiment, the selective control means for the control rod include a piston fixed to the control rod and actuated by hydraulic or pneumatic control.

In another embodiment, the selective control means for the control rod include a core fixed to the control rod and penetrating into an electromagnetic coil to which electrical control signals are applied.

The control device may further include a return spring returning the control rod and the abutment towards their rest position in the absence of any external control.

In a particular configuration, the control rod is disposed in the midplane of the vane, and springs are interposed between the casing and grooves formed in the vane on either side of its housing for receiving the abutment, thereby keeping the vane pressed against the periphery of the rolling piston whenever the abutment is in its rest position.

In one possible application, the selective control means for the control rod are actuate at instants which are predetermined relative to the rotation of the rolling piston.

The device of the invention may be used in any application where a rolling piston rotary machine is required to operate sequentially while its drive motor operates continuously.

Thus, the invention is applicable, in particular, to off-loading compressors used for vehicle brakes or to off-loading compressors used for air conditioning in cars.

The invention is also applicable to multicylinder machines so as to enable fractioned power operation to take place, depending on whether all or only some of the control devices applied to the vanes of the various different cylinders are actuated. For example, in a three cylinder machine, it is possible, in this way, to obtain full load operation, two-thirds load operation, one-third load operation, or complete off-loading, depending on whether none, one, two, or three of the vane retraction control devices of the invention are actuated.

BRIEF DESCRIPTION OF THE DRAWING

Embodiments of the invention are described by way of example with reference to the accompanying drawing, in which:

FIG. 1 is a view of a rolling piston rotary machine of the invention in section on a plane perpendicular to the axis of the rolling piston, the machine being fitted with a device for controlling the position of a vane, and with the vane being shown in its working position;

FIG. 2 is a section view through the vane control device of FIG. 1 on line II—II in FIG. 1; and FIG. 3 is a fragmentary section view analogous to FIG. 2 and showing a variant embodiment of the control device shown in FIGS. 1 and 2.

DETAILED DESCRIPTION

FIG. 1 is a section view through a rolling piston rotary machine, such as a compressor, to which the invention is applicable.

The compressor comprises a casing 9 defining a chamber 40 having a cylindrical wall and containing a rotary annular piston 7 capable of rolling in contact with the wall of the chamber 40. A ring 8 for driving the piston 7 is mounted inside the piston 7, e.g. via an interposed roller bearing 35, so as to be capable of sliding relative of the piston 7. The piston 7 is kept pressed against the its rolling path by resilient compensation means 32 bearing against the central drive shaft 31 and the bore of the ring 8. The ring 8 is coupled to a crank 33 on the central shaft 31 by means of a journal 34.

A separator vane or plane blade 1 is slidably mounted in a housing 41 in the casing 9 to project into the chamber 40, and it divides the empty space around the piston 7 into tow variable volume compartments 38 and 39. The low pressure compartment 39 is in communication via an inlet port 36 with a suction duct (not shown), while the high pressure compartment 38 is in communication via outlet ports 37 and 37' (at least some of which are provided with non-return valves) with a delivery duct (not shown).

The communication between high pressure compartment 38 and outlet ports 37 and 37' occurs through intermediate outlet port 41 in a manner known in the art.

The above description relates to a rolling piston rotary machine of known type and the invention is not limited to this particular type of rolling piston rotary machine.

As can be seen in FIG. 2, springs 2 and 3 are interposed within chamber 13 between the top wall 4 of the casing 9 and housings 5 and 6 formed in the top portion of the vane 1 in order to hold the bottom face of the vane 1 pressed against the peripheral surface of the rolling piston 7 so long as the device 10 for controlling the position of the vane 1 is at rest (which device is described below).

The device 10 for controlling the position of the vane 1 and shown in FIGS. 1 and 2 essentially comprises a control rod 14 disposed in the plane of the vane 1 and substantially in the middle thereof. The control rod 14 has a retaining abutment 12 at its bottom end, which abutment is engaged in a housing 11 formed in the vane 1. The housing 11 has a top wall 25 through which the control rod 14 passes and which cooperates with the abutment 12 when the abutment is displaced upwards by the control rod 14. The vertical extent of the housing 11 is not less than the maximum distance that may arise between the peripheral surface of the piston 7 and the wall of the cylindrical chamber 40. When the abutment 12 is in its lowered or rest position (FIGS. 1 and 2), the opening 11 allows the vane 1 to move freely relative to the abutment 12 and thus to rise against the action of springs 2 and 3 when the rotary piston 7 pushes against the bottom edge of the vane 1 during its rotation.

The rod 14 for controlling the abutment 12 is itself capable of being raised against the action of a return spring 16 interposed between a piston 15 fixed to the rod 14 and the fixed top wall of a housing 17 in which said piston 15 slides. When no external command is applied, the spring 16 urges the control rod 14 and its abutment 12 into the rest position as shown in FIGS. 1 and 2 so that the normal operation of the rotary machine is not modified by the device 10, and the machine operates at full load.

FIGS. 1 and 2 show a first embodiment of selective control means for the control rod 14.

The piston 15 fixed to the rod 14 and provided with a piston ring 23 is suitable for sliding in the bore 17 under the action of pneumatic or hydraulic pressure applied selectively by any means known in the art such as a control unit 70 via a port 18 situated in the wall of the cylinder 26 defining the bore 17, and beneath the piston 15 when in its rest position. The piston 15 thus rises against the action of the spring 16 taking the rod 14 with it, thus raising the abutment 12 and the vane 1 which is entrained by the portion 25 co-operating with the abutment 12. When the rod 14 and the abutment 12 are in the raised or working position, then the piston can rotate freely without coming into contact with the vane 1 and the machine is off-loaded. However, it is also possible to raise the rod 14 and the abutment only half way, for example, such that the periphery of the rolling piston 7 comes into contact with the bottom edge of the vane 1 only during a fraction of a revolution of the piston. The rotary machine thus operates at a reduced load but is not completely off-loaded. It is thus possible to adjust the position of the piston 15 by acting on the pressure applied to the piston 15 via the port 18, thereby adjusting the position of the abutment 12 and of the vane 1 and thus making it possible to regulate the load on the machine. It is also possible to apply pressure to the control device 10 or alternatively counter pressure via a port 19, at instants which are predetermined relative to the rotation of the rolling piston 7, if means are provided for detecting the rotation of the piston 7.

In any event, the rod 14 can be moved to its working position and returned to its rest position progressively in stages, enabling the abutment 12 to be raised or lowered progressively over several revolutions of the piston 7. This means that there is no special wear on the abutment 12 in the housing 11 since the abutment 12 moves in the same direction as that in which the vane 1 oscillates, unlike prior devices in which a catch moves in a direction which is perpendicular to the displacement of the vane.

FIG. 3 shows a variant embodiment in which the rod 14 is not actuated by pressure but is actuated instead by electromagnetic means. In this case, the control rod 14 may also include a guide portion 15 of larger cross-section and moving in the housing 17 of a cylinder 26 and serving as an abutment for one end of a return spring 16 whose other end bears against the end of the housing 17. The rod 14 is, however, extended by means of a core 20 which penetrates into the air gap of an electromagnet 21 placed in a cylinder 22 on top of the cylinder 26, for example. In this case, the control rod 14 can be raised to its working position merely by applying a suitable electrical control signal selectively to the electromagnet 21 by any means known in the art such as a control unit 80, with the core 20 being attracted by the electromagnet 21, and the rod can be allowed to return to its rest position under the action of the return spring 16 when the electrical feed to the coil of the electromagnet 21 is switched off. However, as with pressure control, the embodiment shown in FIG. 3 is capable of providing accurate progressive or partial control of the control rod 14 so as to regulate the load on the machine in complete safety and without subjecting the control mechanism to rapid wear.

I claim:

1. A rolling piston rotary machine comprising a casing, a cylindrical chamber formed inside the casing, a drive shaft coaxial with said chamber and provided with an eccentric, a rolling piston which rolls against the inside surface of the wall of the cylindrical chamber when the shaft rotates, a vane slidably mounted relative to the casing of the machine and dividing the empty space around the piston into a low pressure compartment into which a suction port for a fluid opens out, and a high pressure compartment into which a fluid delivery port opens out, at least one spring interposed between the casing and the vane to press the vane in normal operation against the peripheral surface of the rolling piston, and a control device for controlling the position of the vane, the control device including a control rod movable in translation under the action of selective control means and capable of moving between a first position in which the vane is kept in contact with the peripheral surface of the rolling piston with the motion of the vane not being limited by the control rod, and a second position in which the vane is held by the control rod in a disengaged position where it is not in permanent contact with the peripheral surface of the rolling piston, thereby preventing the rotary machine from operating at full load, wherein the control rod is disposed in the same plane as the vane and includes a retaining abutment formed at the bottom end of the control rod and engaged in a housing formed in the vane, which housing includes a top wall through which the control rod passes, enabling the top wall to co-operate with said abutment when the vane is held by the control rod in a disengaged position, the vertical extent of the housing being not less than the maximum distance between the peripheral surface of the piston and the casing of the rotary machine, thereby allowing the vane to move freely relative to the abutment when the abutment is in its lowered position.

2. A rotary machine according to claim 1, wherein the stroke of the control rod is large enough to make it possible, if necessary, for the wave to be completely retracted when the abutment is in its raised or working position.

3. A rotary machine according to claim 1, wherein the selective control means for the control rod include a piston fixed to the control rod and actuated by hydraulic or pneumatic control.

4. A rotary machine according to claim 1, wherein the selective control means for the control rod include a core fixed to the control rod and penetrating into an electromagnetic coil to which electrical control signals are applied.

5. A rotary machine according to claim 1, including a return spring returning the control rod and the abutment towards their rest position in the absence of any external control.

6. A rotary machine according to claim 1, including a control rod is disposed in the midplane of the vane, and wherein springs are interposed between the casing and grooves formed in the vane on either side of its housing for receiving the abutment, thereby keeping the vane pressed against the periphery of the rolling piston whenever the abutment is in its rest position.

7. A rotary machine according to claim 1, wherein the selective control means for the control rod are actuated at instants which are predetermined relative to the rotation of the rolling piston.

* * * * *